United States Patent [19]

Maytum et al.

[11] Patent Number: 4,673,844

[45] Date of Patent: Jun. 16, 1987

[54] STARTER CIRCUIT FOR A FLUORESCENT TUBE LAMP

[75] Inventors: Michael J. Maytum, Willington, England; Anthony Lear, Edinburgh, Scotland

[73] Assignee: Texas Instruments Incorporated, Dallas, Tex.

[21] Appl. No.: 781,546

[22] Filed: Sep. 30, 1985

[51] Int. Cl.[4] ..... H05B 37/00

[52] U.S. Cl. ..... 315/200 R; 315/101; 315/207; 357/38; 357/46; 357/86

[58] Field of Search ..... 357/38, 86, 46; 315/101, 200 R, 207

[56] References Cited

U.S. PATENT DOCUMENTS

| | | | |
|---|---|---|---|
| 3,265,909 | 8/1966 | Gentry | 357/38 |
| 3,337,783 | 8/1967 | Stehney | 357/38 |
| 3,643,127 | 2/1972 | Laupman | 315/101 |
| 3,693,054 | 9/1972 | Anderson | 357/46 |
| 3,725,752 | 4/1973 | Garrett | 357/46 |
| 3,942,070 | 3/1976 | Tomura et al. | 315/101 |
| 4,119,887 | 10/1978 | Iyama et al. | 315/101 |
| 4,315,274 | 2/1982 | Fukui et al. | 357/38 |

*Primary Examiner*—Harold Dixon

*Attorney, Agent, or Firm*—John A. Haug; James P. McAndrews; Melvin Sharp

[57] ABSTRACT

A starter circuit for a fluorescent tube lamp is connected between the cathode heaters of the tube to provide an initial heating current and then changes to a high impedance to ignite the tube. The circuit is fed by raw rectified a.c. and has a main thyristor requiring a high holding current to maintain the initial conduction. The current through the main thyristor sets up a voltage across a series diode which triggers a second thyristor to reduce the gate voltage of the main thyristor. The main thyristor ceases conduction when the current falls below the holding value and the inductive ballast impedance then produces a high energy striking pulse for the tube. The pulse voltage is limited to increase its duration. One embodiment generates a single pulse only each time the circuit is switched on and another embodiment produces pulses for a period of time before becoming quiescent. The main thyristor and the voltage limiting means are embodied in a monolithic semiconductor structure.

9 Claims, 6 Drawing Figures

STARTER CIRCUIT FOR A FLUORESCENT TUBE LAMP

This invention relates to a starter circuit for a fluorescent tube lamp, a semiconductor device for use in the circuit and a lamp fitting incorporating the circuit.

Fluorescent tubes are lamps which produce light by means of an electrical discharge in a gas which excites a phosphor coating on the tube. When in operation, the impedance of the tube is negative and therefore requires an added series impedance so that the operation is stable. For AC circuits the series impedance is usually chosen to be reactive so as to reduce power losses.

Once the tube has been struck the "running" voltage is between 20 and 60 percent of the nominal AC supply voltage, the remainder of that voltage being dropped across the added series impedance. The purpose of a starting circuit is to strike the discharge in the tube and the voltage required to achieve this is higher than the running voltage and depends on the age of the tube, its operational environment and the length of time for which striking voltage is applied. Tubes have heated cathodes which provide a source of ions and electrons for the discharge and reduce the magnitude of the voltage required to strike the tube. It is possible to strike a tube when the cathodes are cold but the striking voltage/time requirement is usually beyond the capability of conventional starting circuits; and, in any case, the cold striking of a tube tends to shorten its life. Moreover the high voltages required for the larger tube sizes would call for correspondingly high voltage components, so that cold striking is not normally used for such tubes. It is therefore a function of starting circuits to provide a period for which current is applied to the cathodes to heat them and a well-known circuit for achieving this includes a glow tube switch which is used to complete a series circuit including the ballast series impedance and the two cathode heaters, the switch itself being connected between the two cathode heaters. When power is first supplied to the circuit, the full AC supply voltage is applied to the glow tube in which a discharge is set up and the heat of this discharge heats up a bimetallic strip. When sufficiently hot, this strip closes some switch contacts which short-circuit the glow tube and cause the cathode heaters to be heated by the supply current. After a certain period of time the bimetallic strip cools allowing the switch to open again which interrupts the heater current and causes the ballast impedance, which is usually an inductor, to produce an e.m.f. in addition to the supply voltage which is usually sufficient to strike the tube. If the tube does not strike, the glow tube switch will repeat its attempt to strike it as described above. After the tube has struck insufficient voltage is applied to the glow tube for the discharge to be set up in it and the starter remains quiescent.

The main problems with the glow tube switch as described above are that the actual time of opening of the switch is random relative to the supply voltage so that the actual e.m.f. applied to the tube in an attempt to strike it is frequently insufficient so that the striking of the tube is delayed and it is preceded by an unpleasant series of flashes. Furthermore, the performances of the glow tube starters are very variable which can result in unreliable operation in some instances. In addition, the life expectancy of the glow tube switch is unpredictable. Moreover, the continued attempts to strike a faulty tube by such a switch can be very annoying.

In order to overcome the above disadvantages of a glow tube starter switch certain semiconductor solutions have been proposed, but in many instances the circuits are quite complicated so that the switch cannot be manufactured as cheaply as a glow tube switch and cannot be fitted into the small cylindrical package used for such switches so that they cannot be regarded as an in-service replacement for the glow tube switch.

It is an object of the present invention to provide an improved form of electronic circuit for starting a fluorescent tube lamp which overcomes the disadvantages of the glow tube switch and many of the disadvantages of the semiconductor replacements for the glow tube switch.

According to one aspect of the present invention there is provided a starter circuit for an a.c. energised fluorescent tube lamp having cathodes with heaters and an inductive ballast impedance in which in use the circuit is connected between the cathode heaters of the tube itself and presents a low impedance enabling the heaters to be energised during part of the starting procedure and a high impedance whilst the tube is running, the circuit including a thyristor having a controlled current path for connection netween the cathode heaters and the transition from low impedance to high impedance of that path occurs when the cyclically varying current through the controlled path falls below the holding current of the thyristor, wherein the thyristor is so constructed as to require a high holding current and the circuit is such that in use the inductive ballast impedance stores energy corresponding substantially to the passage of the high holding current through it at the instant of the transition from low impedance to high impedance so that the energy is converted to a high voltage striking pulse which is applied to the tube.

The starter circuit may include voltage limiting means connected in parallel with the controlled current path of the thyristor to restrict the amplitude of the voltage pulse from the inductive ballast impedance and thereby extend its duration. The thyristor and the voltage limiting means may be embodied in a monolithic power semiconductor structure. Since the amount of energy stored in the inductive ballast impedance at the instant of the transition from low impedance to high impedance of the controlled current path is fixed by the holding current of the thyristor and the inductance of the impedance, and the voltage of the supply at that instant is predetermined, it follows that the use of the voltage limiting means will result in a pulse of known amplitude and duration being applied to the tube. Preferably the parameters determining the amplitude and duration of the pulse are chosen to suit the starting conditions required by the tube.

In order to provide for the heating of the cathodes the thyristor needs to be held in the low impedance condition for a period of preheating appropriate to the tube. This can be achieved by providing a resistive connection from the anode of the thyristor to its gate to hold it in conduction and then short-circuiting the gate to the cathode of the thyristor or otherwise holding the gate bias sufficiently negative at the end of the preheating period so that the thyristor switches to the high impedance condition when the current next falls below the holding value. The duration of the preheating period may be made inversely dependent on the preheating current so that the same starting circuit is suitable for different sizes of tube.

The circuit may be arranged to produce only a single striking pulse before it becomes quiescent or it may produce striking pulses for a predetermined period and then become quiescent.

Preferably the circuit includes a diode bridge rectifier circuit so that the conductive state of the thyristor can control the current in both phases of the a.c. supply. Alternatively a single diode half wave rectifier may be used provided that adequate power can be applied to the cathode heaters when the thyristor is conducting.

According to a second aspect of the invention there is provided a semiconductor device having a single body of semiconductor material of a first oonductivity type with a first region, of a second conductivity type, in one major face of the body, second and third regions, of the second conductivity type, in the other major face of the body, a fourth region, of the first conductivity type, in the surface of the second region, and a fifth region, of the first conductivity type, in the surface of the third region, the fifth region being joined by a conductive link to the second region, wherein the first region, body, and second and fourth regions form a main thyristor, and the first region, body and third and fifth regions form an auxiliary thyristor, in which the controlled path of the auxiliary thyristor is connected from the terminal which it shares with the controlled path of the main thyristor to the gate of the main thyristor via the conductive link, the gate of the auxiliary thyristor being formed by the third region and able to provide control of the controlled paths of both thyristors.

The invention also includes a lamp fixture for a fluorescent tube lamp having a starter circuit according to the first or second aspect of the invention.

In order that the invention may be fully understood and readily carried into effect, it will now be described with reference to the accompanying drawings, of which:

Figure 1:
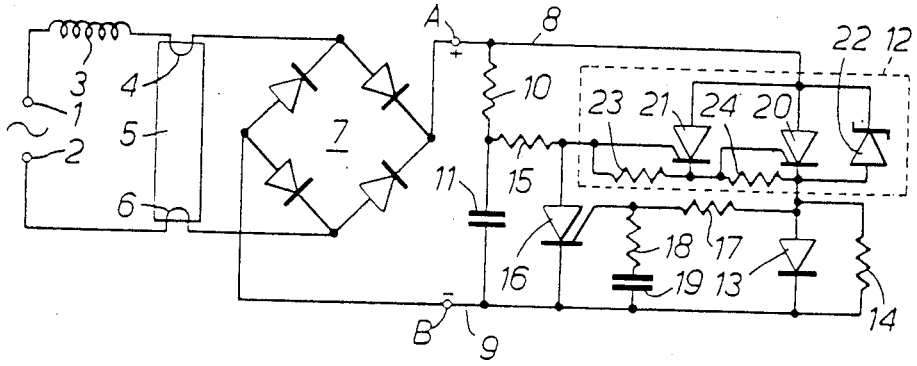
FIG. 1 is a diagram of one example of a starter circuit.

Referring now to FIG. 1, a.c. supply terminals 1 and 2 are provided of which the terminal 1 is connected through a ballast choke 3 to one end of a cathode heater winding 4 of a fluorescent tube lamp 5. The terminal 2 is connected directly to an end terminal of the heater 6 of a second cathode of the tube 5. The other ends of the heaters 4 and 6 are connected across a diagonal of a diode bridge rectifier 7 of which the output diagonal is connected to a positive conductor 8 and a negative conductor 9. The positive conductor 8 is connected to the negative conductor 9 through two parallel circuits. In one of these parallel circuits a resistor 10 and a capacitor 11 are connected in series and in the other parallel circuit a "fluoractor" 12 is connected in series with a diode 13 and a resistor 14 connected in parallel with one another. The junction of the resistor 10 and the capacitor 11 is connected via a resistor 15 to the gate or control electrode of the fluoractor 12, which electrode is connected through a thyristor 16 to the negative conductor 9. The junction of the fluoractor 12 and the diode 13 is connected through a resistor 17 to the gate of the thyristor 16 which electrode is connected to the negative conductor 9 through a series circuit consisting of a resistor 18 and a capacitor 19.

The fluoractor 12 is a monolithic power semiconductor structure which includes a main thyristor 20 and an auxiliary thyristor 21 with their anodes connected together. The cathode of the auxiliary thyristor 21 is connected to the gate of the main thyristor 20 and the gate of the auxiliary thyristor 21 acts as the gate of the fluoractor. A zener diode or other voltage limiting structure 22 is provided in parallel with the anodecathode path of the main thyristor 20 which forms the controlled current path of the fluoractor 12. The auxiliary thyristor 21 is of conventional thyristor construction and has in effect a resistor 23 of 1 kΩ connected between gate and cathode. The main thyristor 20 has a modified construction with a number of shorting dots shorting the gate to cathode junction, the effect of which is to cause the thyristor 20 to require a particularly high current to hold it in conduction when there is no positive bias on the gate. Another effect of the shorting dots is to produce the effect that the gate is effectively shorted to the cathode of this thyristor through a resistance 24 of about 30Ω. Other effects are produced by the structure and these will be described where appropriate in the description of the operation of the circuit.

The starter circuit consists of the components shown in FIG. 1 to the right of the tube 5 and these would be included in a small cylindrical package such as that used for a conventional glow switch starter and it is intended that they would be directly replaceable items for a glow switch starter.

In the operation of FIG. 1, when the a.c. supply is first connected to the terminals 1 and 2, a relatively small current flows establishing a positive potential on the conductor 8 relative to the conductor 9. Current then flows through the resistor 10 and within a fraction of a second the capacitor 11 is charged to a voltage sufficient to switch the fluoractor 12 into conduction. Once the fluoractor 12 is conducting a relatively large current can flow in both $\frac{1}{2}$ cycles of the a.c. supply by virtue of the diode bridge 7 so that the heaters 4 and 6 of the cathodes of the tube 5 are heated up. During this time the current is effectively controlled by the impedance of the ballast choke 3 and the resistances of the heaters 4 and 6.

As with a conventional glow switch starter, when the heaters have been energised for a sufficient period of time for them to have reached the correct termperature for the tube to be struck, the starting circuit switches to a high impedance. This is achieved in the circuit shown in FIG. 1 by the flow of current through the resistors 17 and 18 which causes the capacitor 19 to be charged up. When the preheating period for the cathodes expires the amount of charge on the capacitor 19 is sufficient to permit the junction of resistors 17 and 18 to have reached a voltage high enough to cause the thyristor 16 to become conducting, thus bringing the potential applied to the gate of the fluoractor 12 down to a voltage close to that of the negative conductor 9. Because the alternating supply is rectified by the diode bridge 7 but is not subjected to any significant smoothing, there is quite a large 100 Hz ripple superimposed on the d.c. supply with the result that the voltage which appears at the junction of the resistors 17 and 18 also contains a significant 100 Hz ripple which ensures that the time of firing of the thyristor 16 occurs near a voltage peak of the a.c. supply. The fluoractor 12 remains conducting as long as the current through it exceeds the holding current of the main thyristor 20. However, the current through the fluoractor 12 which is substantially in phase with the voltage across it follows a succession of half sine waves resulting from the full wave rectification of the a.c. supply. This means that near each zero crossing of the a.c. supply waveform the current through the fluoractor 12 will fall below the holding current and the fluoractor will then cease to conduct. At this time the energy stored in the ballast choke 3 appears as a high voltage pulse because the current has been reduced substantially to zero. The voltage of this pulse is limited by the zener diode 22 built into the fluoractor 12 which permits such current to flow as to hold the voltage at a clamped value determined by the structure of the zener diode 22. Because all of the energy in the choke 3 must appear in the high voltage pulse, it follows that the duration of this pulse will be extended and it can be shown that the duration of the pulse is approximately equal to $$L.I_H/(V_{clamp}+V_{supply})$$

where

L is the inductance of the choke 3

$I_H$ is the holding current of the fluoractor 12

$V_{clamp}$ is the limiting voltage of the zener diode 22 and $V_{supply}$ is the supply voltage at the particular instant.

The above expression is approximately valid for a lagging power factor circuit; for a leading power factor circuit the expression is modified by a change of the positive sign to a negative one in the denominator so that the duration of the pulse is longer. The voltage $V_{clamp}$ is that which is available to strike the tube, it being applied across the two cathodes of the tube.

The above description of the operation of the circuit of FIG. 1 has been simplified to some extent since the structure of the fluoractor 12 results in an appreciable current flowing out of the gate connection whilst the device is conducting, and this current helps to charge the capacitor 11. Although it would appear that the voltage set up across the diode 13 would be insufficient to trigger the thyristor 16, it should be remembered that in operation a considerable current is flowing through the diode 13 so that the voltage established across it is approximately 0.9 volts which is rather larger than the 0.5 volts which is due to the junction itself. In a typical example of the circuit of FIG. 1, the following component types were used.

| Component No. | |
|---|---|
| 7 | 1N400X |
| 10 | 150k |
| 11 | 10 μF |
| 13 | 1N4001 |
| 14 | 3k9Ω |
| 15 | 330Ω |
| 16 | TICP106 |
| 17 | 33kΩ |
| 18 | 3k9Ω |
| 19 | 47 μF |

The circuit of FIG. 1 produces only a single striking pulse because once the thyristor 16 has been triggered into conduction, it remains conducting because sufficient current flows through the resistors 10 and 15 to keep in that condition and therefore the voltage applied to the gate of the fluoractor 12 remains too negative to permit it to conduct. If the striking pulse is not effective in striking the tube the a.c. power may be switched off and reapplied for a second attempt. There is no appreciable delay in the termination of the conduction of the thyristor 16 once the a.c. supply is switched off, because the charge in the capacitor 11 is rapidly reduced through the relatively low resistor 15 and the thyristor 16.

Figure 2:
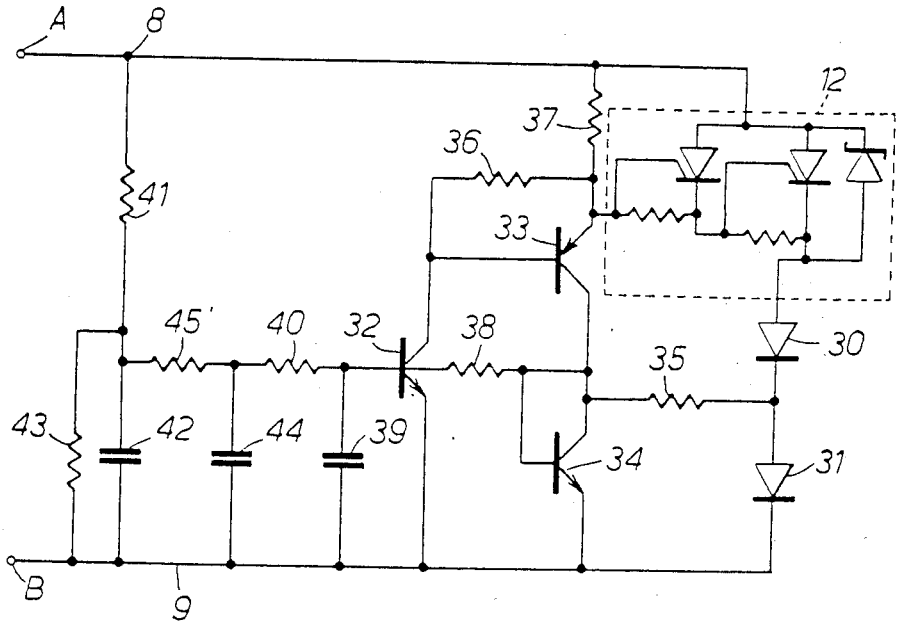
FIG. 2 is a diagram of another starter circuit.

FIG. 2 shows an alternative circuit which produces a plurality of striking pulses over a controlled period after which the circuit becomes quiescent. Components of FIG. 2 which correspond exactly to those of FIG. 1 have the same reference numbers as in that Figure. The terminals A and B of FIG. 2 correspond to those marked on the conductors 8 and 9 in FIG. 1, the remainder of the circuit to the left of those terminals being exactly as shown in FIG. 1.

In FIG. 2, the controlled current path of the fluoractor 12 is connected from the positive conductor 8 through diodes 30 and 31 in series to the negative conductor 9. Transistors 32 and 33 are connected in a regenerative feedback circuit to act as a thyristor but the collector load of the transistor 33 takes the form of a diode-connected transistor 34 connected between the collector of the transistor 33 and the conductor 9. The collector of the transistor 33 is connected to the junction of the diodes 30 and 31 through a resistor 35. The base of the transistor 33 is connected to its emitter through a resistor 36 and that emitter is connected directly to the gate of the fluoractor 12 and through a resistor 37 to the conductor 8. With regard to the transistor 32, its collector is connected directly to the base of the transistor 33, its emitter is connected directly to the conductor 9 and its base is connected through a resistor 38 to the collector of the transistor 33, to the conductor 9 through a capacitor 39 and to one end of a resistor 40. A resistor 41 and a capacitor 42 are connected in series from the conductor 8 to the conductor 9. The capacitor 42 is shunted by a resistor 43. The junction of the resistor 41 and the capacitor 42 is connected through a resistor 45 to the other end of the resistor 40 and the junction of these two resistors is connected to the conductor 9 through a capacitor 44.

The values and types of the components used in FIG. 2 in one example are as follows:

| Component No. | |
|---|---|
| 30,31 | 1N4007 |
| 32 | BC184 |
| 33 | BC212 |
| 34 | BC184 |
| 35 | 220Ω |
| 36 | 1k5Ω |
| 37 | 150kΩ |
| 38 | 680Ω |
| 39 | 1n5F |
| 40 | 33kΩ |
| 41 | 100kΩ |
| 42 | 220 μF |
| 43 | 10kΩ |
| 44 | 47 μF |
| 45 | 29kΩ |

In the operation of FIG. 2, when a.c. power is first applied and a d.c. voltage is established between conductors 8 and 9, current flows through the resistor 37 applying a positive voltage to the gate of the fluoractor 12 which then becomes conducting so that a low impedance is presented between the conductors 8 and 9. In this condition, the preheating current is applied to the heaters of the cathodes of the tube. The current through the fluoractor 12 establishes about 0.9 volts across the diode 31 so that current flows through resistors 35, 38 and 40 to charge the capacitor 44. The size of the capacitor 39 is so much smaller than that of the capacitor 44 that it can be ignored during consideration of this part of the operation of the circuit; the capacitor, 39 is provided to absorb spurious noise pulses which might otherwise trigger the thyristor formed by the transistors 32 and 33. Up to this time the transistors 32 and 33 have been non-conducting, but when the voltage at the base of the transistor 32 reaches about 0.7 volts the transistors 32 and 33 become conducting with the result that the gate of the fluoractor 12 is taken to a more negative value so that the fluoractor becomes non-conducting when the current through it falls below its relatively high holding current. Because the d.c. supply applied to the circuit is unsmoothed full wave rectified a.c., there is a substantial 100 Hz ripple on the d.c. which also appears on the voltage applied to the base of the transistor 32 so that the actual start of conduction of the thyristor formed by the transistors 32 and 33 occurs during that part of the 100 Hz cycle at which the voltage is its most positive. Therefore the actual timing of the switching off of the fluoractor 12 which is determined by the time at which the current through it falls below the required holding current depends to a very large exrent on the timing of the charging of the capacitor 44 from the voltage established across the diode 31. Thus the preheat time of the cathode heaters of the tube is closely controlled and need not depart substantially from an ideal value. Up to now the operation of the circuit of FIG. 2 has been similar to that of FIG. 1. However, in FIG. 2 the gain of the thyristor circuit formed by the transistors 32 and 33 is deliberately restricted by the use of the diode-connected transistor 34 as the collector load of the transistor 33 so that it like the fluoractor 12 requires a relatively high current to hold it in conduction, although its holding current is much lower than that of fluoractor 12. Thus shortly after the fluoractor 12 has ceased conduction so the thyristor formed by the transistors 32 and 33 also ceases conduction. As a result of this action the conductive states of the fluoractor 12 and the thyristor formed by the transistors 32 and 33 are the same as they were initially and the generation of a striking pulse can recur. Of course, the period of time necessary to build up an adequate voltage at the base of the transistor 32 to cause the thyristor formed by the transistors 32 and 33 to start conducting again is shorter than it was initially because of the residual charge stored in the capacitor 44, but as the cathodes of the tube are already heated, it is not necessary for current to be fed through the cathode heaters for the full reheat period between its striking pulses.

The structure of the fluoractor is such that whilst it is conducting and also whilst it is clamping the voltage being applied across it, current flows out of the gate connection and this current flows through the thyristor formed by the transistors 32 and 33 to charge up not only the capacitor 44 but also the capacitor 42. Therefore, during each striking pulse the charge stored in the capacitor 42 is increased with the result that if the tube fails to strike after a few seconds sufficient charge will have been accumulated by the capacitor 42 for the voltage at the base of the transistor 32 to be high enough to hold the thyristor formed by the transistors 32 and 33 in conduction whenever a positive voltage appears at the emitter of the transistor 33. This means that the fluoractor 12 does not become conducting and the circuit assumes a quiescent state in which the charge on the capacitor 42 is sustained by current flow through the resistor 41 and the thyristor formed by the transistors 32 and 33 is continuously conducting.

Figure 3:
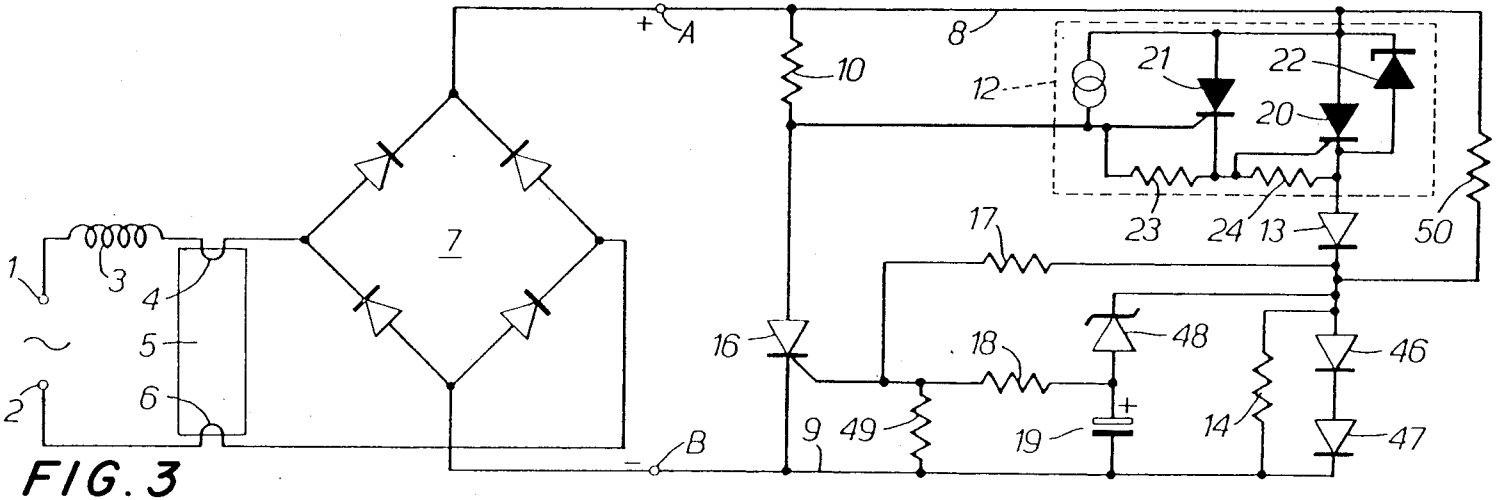
FIG. 3 is a diagram of a further example of a starter circuit.

FIG. 3 shows a further starter circuit according to the invention which is similar to the circuit shown in FIG. 1 but which provides a plurality of striking pulses over a controlled period as does the circuit of FIG. 2. Comparing FIG. 3 with FIG. 1, it will be seen that the capacitor shunting the thyristor 16 has been removed, the controlled path of the fluoractor 12 has been shunted by a resistor and the firing circuit in the thyristor 16 has been made more complex to provide the succession of striking pulses. The functions of the additional parts will become apparent from the following description of the operation of the circuit.

When the power is switched on, current flows from A through the resistor 10, the fluoractor 12, the diode 13 and the resistor 14 to B, some current also flowing through the resistor 50 in series with the resistor 14. This current triggers the fluoractor 12 into conduction which causes the pulsing dc set up across the diodes 46 and 47 to charge the capacitor 19 through 17 and 18, the Schottky diode being reverse biassed for most of the 100 Hz cycle. When the capacitor 19 is sufficiently charged, the thyristor 16 is triggered into conduction, thus reducing the control voltage applied to the fluoractor 12 which ceases conduction when the current through it falls below the holding current. At this time the thyristor 16 is kept in a conducting condition by the current flowing out from the gate input of the fluoractor 12 together with the current through the resistor 10. The thyristor ceases conduction when the pulse voltage from the full wave rectifier 7 falls to zero and does not turn on as the next half wave begins because the voltage applied to its gate is too low. The cycle recommences and the capacitor 19 is recharged and the thyristor 16 is triggered again, this time at a slightly earlier time in the half cycle because of the residual charge in the cacacitor 19. If the tube fails to strike, the cycle is repeated with the thyristor being turned on progressively earlier and earlier until finally the capacitor 19 is sufficiently charged that the thyristor is held conducting and the fluoractor 12 does not conduct because the voltage on its gate does not rise sufficiently. A benefit obtained by this progressively earlier triggering of the thyristor 16 is that the fluoractor can be turned off before the current through it has risen to the holding current so that after the striking pulse the tube receives a greater proportion of a half cycle of current through it which will assist in maintaining the discharge. When the power is turned off the capacitor 19 is discharged quickly through the diodes 46, 47 and 48.

Figure 4:
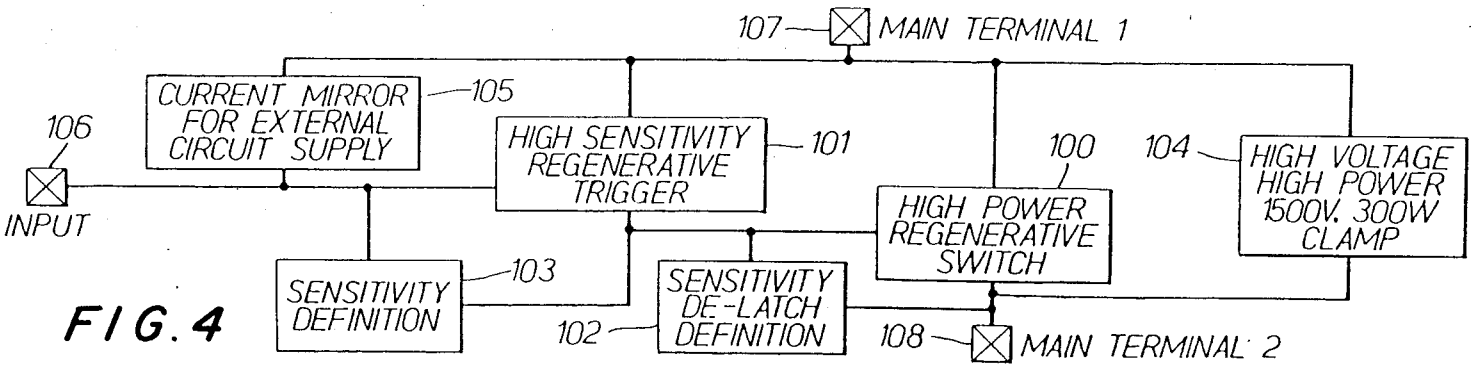
FIGS. 4, 5 & 6 show a functional diagram, a nominal circuit diagram and a physical configuration respectively of a "fluoractor" suitable for use in the circuits of FIGS. 1, 2 and 3.
Figure 5:
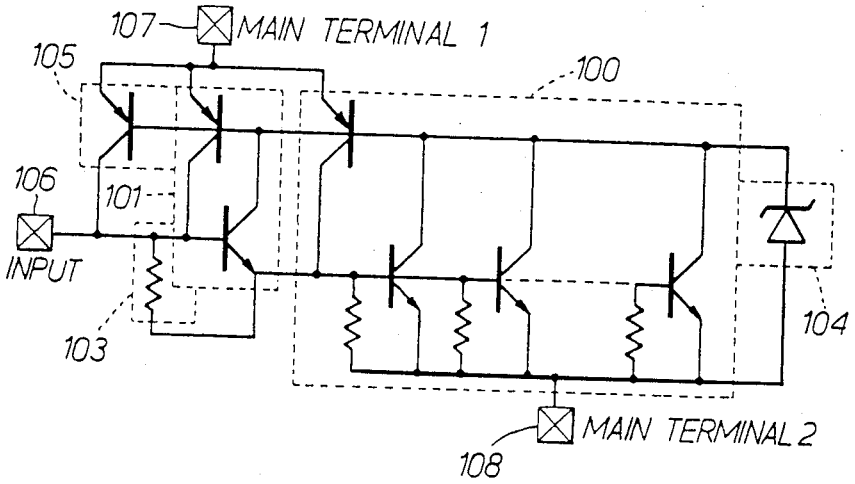
Figure 6:
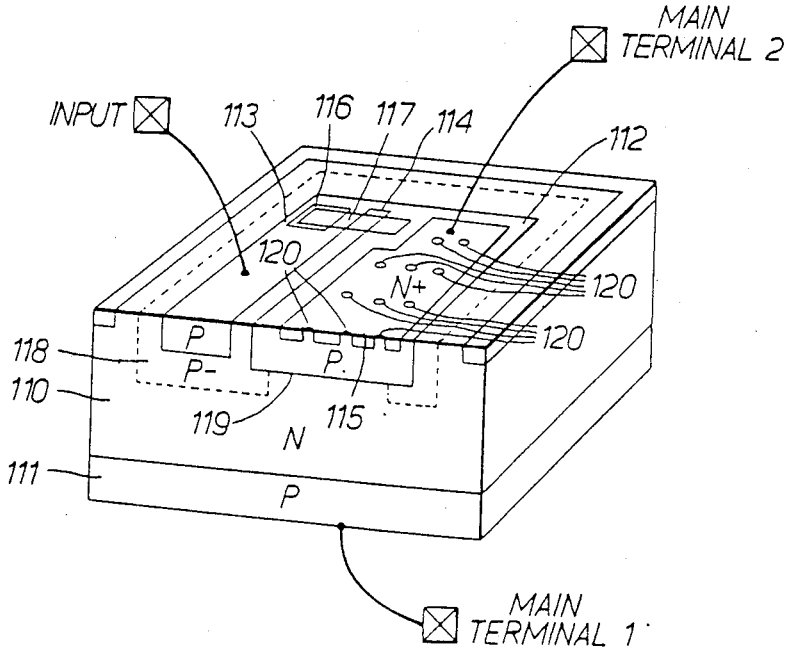

FIGS. 4, 5 and 6 show details of the fluoractor 12, it being constructed as a monolithic semiconductor device. FIG. 4 is a block diagram of the functions of the device, FIG. 5 a nominal circuit diagram, and FIG. 6 a diagram partly in cross-section of the device itself.

In FIG. 4, the high power regenerative switch 100 is the main thyristor of the device and the high sensitivity regererative trigger 101 is the auxiliary thyristor. The sensitivity delatch definition function 102 is performed by the shorting dots in the main thyristor and the sensitivity definition function 103 of the auxiliary thyristor is provided by a resistor connecting the gate of that thyristor to an end terminal of its controlled current path.

The high voltage clamp function 104 is an avalanche breakdown diode formed in the construction of the main thyristor and the current mirror 105 is provided by a transistor having its collector connected to the gate input 106 of the device, which transistor is connected in parallel with one of the transistors forming the auxiliary thyristor 101. The controlled current path of the device is between main terminals 107 and 108.

The above outline description of FIG. 4 will help in understanding the functions of the elements of the circuit of FIG. 5. As far as possible, the references used in FIG. 4 have been used in FIG. 5. The dotted outlines in FIG. 5 have been numbered with the reference numbers used in FIG. 4 indicating that the parts enclosed perform the functions shown in FIG. 4. It will be noted that the thyristors are shown as regeneratively connected pairs of transistors. In the main thyristor 100, one of the transistors is shown as being composed of a plurality of transistors connected in parallel; this is partly because the transistor concerned is a high power one and partly because the resistors performing the sensitivity delatch definition function 102 of FIG. 4 are distributed and respectively connect the base to the emitter of each of the transistors of the plurality.

Referring now to FIG. 6 which shows partly in cross-section the device itself; the device has a body 110 of N-type silicon with a region 111 of P-type conductivity formed on its lower major face. An ohmic contact is made to the region 111 and this forms the main terminal 1 of the device. In the upper main face of the body 110 there are formed two regions, 112 and 113, of P-type conductivity joined by a short bridge 114 also of P-type conductivity. In the region 112 is formed a further region 115 of $N^+$ conductivity to which an ohmic connection is made and provides the main terminal 2. The input or gate of the device is provided by an ohmic connection to the region 113. In the region 113 another region 116 of $N^+$ type conductivity is formed and this is connected by a conductive link 117 to the region 112 at a position near the bridge 114. The regions 112 and 113 are enclosed by a region 118 of P-type conductivity having a reduced impurity concentration; this is shown in FIG. 6 as $P^-$. The region 118 does not completely enclose the regions 112 and 113 but leaves uncovered the central substantially planar part 119 of the interface between the region 112 and the body 110. The $N^+$ type region 115 is provided with small areas 120 through which the P-type material of the region 112 still extends to the upper surface of the body 110 and the conductive connection forming the main terminal 2 is connected not only to the $N^+$ regions 115 but also to the P region 112 at the places 120. These perforations through the region 115 form the base to emitter resistors which perform the sensitivity delatch definition function 102 by causing the main thyristor to have a relatively high holding current.

The regions 115 and 112 together with the body 110 and the region 111 form the main thyristor, and the regions 116, 113 together with the body 110 and the region 111 form the auxiliary thyristor. As explained above, the perforations 120 through the region 115 provide the base to emitter resistors shown in FIG. 5 on the main thyristor 100. The sensitivity definition function 103 of the auxiliary thyristor is provided by the bridge 114 through which the region 116 is connected to the region 113 so that it acts as a base to emitter resistor as shown in FIG. 5. The current mirror transistor 105 is formed by the region 113, the body 110 and the region 111, this appearing as a separate component from part of the auxiliary thyristor 101 because the $N^+$ type region 116 is located towards one end of the region 113. The $P^-$ region 118 covers the corners of the PN junctions between the regions 112 and 113 and the body 110 so as to prevent premature reverse voltage breakdown in these areas. The reverse voltage breakdown PN junction between the region 112 and the body 110 is confined to the area 119 not covered by the $P^-$ region 118 which forms an accurately controlled avalanche diode clamp performing the function 104 shown in FIG. 4.

Although in FIG. 6 the region 111 is shown over the whole of the lower major face of the body 110, it need not do so provided that it covers those parts of the major face which are opposite the regions 112 and 113 in the other major face. Similarly, the perforations 120 need not take the form shown but could be narrow slits or any other geometrical configuration providing the required resistive connection of the region 112 to the main terminal 2 distributed evenly over the area of the region 115. In fact, many other geometrical configurations having the same properties as that shown in FIG. 6 will be apparent to those skilled in the art. The device may be manufactured using conventional planar integrated circuit techniques including diffusion and/or ion implantation.

Among the advantages of starter circuits described are the fact that the timing of the pre-heat current can be quite precisely controlled so that the tube cathodes reach the optimum temperature for striking the tube and that the voltage clamping action of the fluoractor serves not only to limit the voltage stresses on the components of the circuit but also to extend the duration of the striking pulse applied to the tube which has been found to make the striking of the tube more reliable than with a shorter pulse. In order to make a starter circuit better suited to a range of tube sizes the voltage set up across the diode (13 of FIG. 1 or of FIG. 2) from which the firing voltage for the thyristor (16 of FIG. 1 or 32,33 of FIG. 2) is built up may be arranged to be dependent on the magnitude of the cathode heater current by including a resistor in series with the diode. In addition, the energy in the striking pulse is accurately controlled because of the way in which it is generated.

All of the starter circuits described above are arranged so that if the tube fails to strike after either a single striking pulse or a succession of striking pulses over a predetermined time interval the starter circuit becomes quiescent and produces no further striking pulses until it has been switched off and then on again. This is achieved by ensuring that the driving thyristor remains turned on and therefore shorting the gate of the fluoractor to ground.

The starting circuits described have a number of advantages additional to those mentioned above. In particular, as the pre-heating requirement of the tube becomes greater with falling temperature, the same fall in temperature will effectively reduce the charging current of the pre-heat timing capacitor 19 or 44, thus automatically providing a longer pre-heat time.

Although the circuits described have used a full wave rectifier cicuit, half wave rectification could be used instead, allowance being made for the effectively smaller heater current and the intervals between the rectified current pulses.

What we claim is:

1. A semiconductor device having a single body of semiconductor material of a first conductivity type with a first region, of a second conductivity type, in one major face of the body, second and third regions, of the second conductivity type, in the other major face of the body, a fourth region, of the first conductivity type, in the surface of the second region, the fourth region having evenly distributed parts of the second region penetrating it so that contact material on the fourth region produces resistive connections in parallel with the p-n junction between the second and fourth regions and a fifth region, of the first conductivity type, in the surface of third region, the fifth region being joined by a conductive link to the second region, wherein the first region, body, and second and fourth regions from a main thyristor, and the first region, body and third and fifth regions form an auxiliary thyristor, in which the controlled path of the auxiliary thyristor is connected from the terminal which it shares with the controlled path of the main thyristor to the gate of the main thyristor via the conductive link, the gate of the auxiliary thyristor being formed by the third region and able to provide controlled paths of both thyristors.

2. A device according to claim 1, including a section of the second conductivity type joining the third region to the second region.

3. A device according to claim 1 in which the semiconductor device functions as an integrated switch circuit and further including a lamp fixture including lamp terminals for receiving a fluorescent tube lamp having cathodes with heaters, an inductive ballast impedance connected in series between the lamp terminals and A.C. supply terminals and a starter circuit, the starter circuit including a rectifier connected to the lamp terminals to supply a rectified voltage to the switching circuit.

4. A lamp fixture according to claim 3 wherein the starter circuit is mounted in a box detachable from the fixture and of substantially the same size and shape as a conventional fluorescent lamp starter switch.

5. A semiconductor device having a single body of semiconductor material of a first conductivity type with a first region, of a second conductivity type, in one major face of the body, second and third regions, of the second conductivity type, in the other major face of the body, a fourth region, of the first conductivity type, in the surface of the second region, a fifth region, of the first conductivity type, in the surface of the third region, the first region being joined by a conductive link to the second region, and a sixth region of the second conductivity type, but of lower impurity concentration than the second and third regions, enclosing the second and third regions except for a central substantially planar part of the interface between the second region and the body wherein the first region, body, and second and fourth regions form a main thyristor, and the first region, body and third and fifth regions form an auxiliary thyristor, in which the controlled path of the auxiliary thyristor is connected from the terminal which it shares with the controlled path of the main thyristor to the gate of the main thyristor via the conductive link, the gate of the auxiliary thyristor being formed by the third region and able to provide control of the controlling paths of both thyristors.

6. A device according to claim 5 in which the semiconductor device functions as an integrated switching circuit and further including a lamp fixture including lamp terminals for receiving a fluorescent tube lamp having cathodes with heaters, an inductive ballast impedance connected in series between the lamp terminals and A.C. supply terminals and a starter circuit, the starter circuit including a rectifier connected to the lamp terminals to supply a rectified voltage to the switching circuit.

7. A lamp fixture according to claim 6 wherein the starter circuit is mounted in a box detachable from the fixture and of substantially the same size and shape as a conventional fluorescent lamp starter switch.

8. A device according to claim 5 wherein the fourth region has evenly distributed parts of the second region penetrating it so that contact material on the fourth region produces resistive connections in parallel with the p-n junction between the second and fourth regions.

9. A device according to claim 8 including a section of the second conductivity type joining the third region to the second region.

* * * * *

UNITED STATES PATENT AND TRADEMARK OFFICE

CERTIFICATE OF CORRECTION

PATENT NO. : 4,673,844

DATED : 06/16/87

INVENTOR(S) : Michael J. Maytum et al

It is certified that error appears in the above-identified patent and that said Letters Patent is hereby corrected as shown below:

On the Title page, item [75], 3rd line et seg. should read
- Scotland; Stephen W. Byatt, Bedford, England; Richard A. A. Rodrigues, Peebleshire, Scotland -

Signed and Sealed this

Fifteenth Day of June, 1993

Attest:

Michael K. Kirk

MICHAEL K. KIRK

Attesting Officer

Acting Commissioner of Patents and Trademarks